US008100380B2

(12) United States Patent
Goertzen

(10) Patent No.: US 8,100,380 B2
(45) Date of Patent: Jan. 24, 2012

(54) IGLOO BUILDING BLOCK MOLD

(76) Inventor: Norm Goertzen, Winnipeg (CA)

( * ) Notice: Subject to any disclaimer, the term of this patent is extended or adjusted under 35 U.S.C. 154(b) by 608 days.

(21) Appl. No.: 12/236,799

(22) Filed: Sep. 24, 2008

(65) Prior Publication Data

US 2009/0078849 A1 Mar. 26, 2009

Related U.S. Application Data

(60) Provisional application No. 60/974,648, filed on Sep. 24, 2007.

(51) Int. Cl.
*E04G 11/00* (2006.01)
*B41D 3/04* (2006.01)
*E04C 3/30* (2006.01)

(52) U.S. Cl. ..... 249/154; 249/117; 249/18; 52/575; 52/609

(58) Field of Classification Search ..... 249/18, 249/66.1, 117, 134, 154; 52/286, 575
See application file for complete search history.

(56) References Cited

U.S. PATENT DOCUMENTS 167,831 A * 9/1875 Foster ..... 52/245
495,411 A * 4/1893 Heatley ..... 52/575
1,281,976 A * 10/1918 Keim ..... 52/575
1,374,490 A * 4/1921 Chrisman ..... 52/575
2,752,631 A * 7/1956 Wendt ..... 425/181
3,269,070 A * 8/1966 Stoy ..... 52/249
3,572,625 A * 3/1971 Williamsen ..... 249/117
3,713,431 A * 1/1973 LeBaron ..... 125/39
3,816,048 A * 6/1974 Berry et al. ..... 425/318
4,154,423 A 5/1979 Crock
6,210,142 B1 4/2001 Huesers et al.

* cited by examiner

*Primary Examiner* — Darnell Jayne
*Assistant Examiner* — Timothy M Ayres
(74) *Attorney, Agent, or Firm* — Ryan W. Dupuis; Kyle R. Satterthwiute; Ade & Company, Inc.

(57) ABSTRACT

An igloo building block mold comprises a shell defining a pair of generally cuboid mold portions. The mold portions are offset from one another in both an upright direction extending between the top and bottom ends of the mold portions and a lateral direction extending between the end walls of each mold portion. A building block formed by the mold, when stacked on a previous row of blocks, permits inter-engagement between the blocks due to a shoulder being formed on each block which engages the corresponding shoulder of a previous block supported therebelow. The offset in the lateral direction permits side edges of each block to be inter-engaged with adjacent blocks as the blocks are placed in the desired position in the igloo structure during construction.

10 Claims, 7 Drawing Sheets

IGLOO BUILDING BLOCK MOLD

This application claims the benefit under 35 U.S.C. 119(e) of U.S. provisional application Ser. No. 60/974,648, filed Sep. 24, 2007.

FIELD OF THE INVENTION

The present invention relates a mold for forming a particulate material, for example snow, into a building block suitable for assembly into a walled structure, for example an igloo.

BACKGROUND

Formation of igloos, for shelter and for recreation, is well known. Typically blocks of snow are formed and stacked into a dome like structure; however, due to the inclination of the walls as the dome structure is formed, it is commonly difficult for unskilled persons to properly align the blocks so that they remain in place during construction.

Various tools are known for assisting in the construction of an igloo. U.S. Pat. No. 6,210,142 belonging to Huesers and U.S. Pat. No. 4,154,423 belonging to Crock disclose examples of tools to assist construction of an igloo type structure.

Huesers discloses a complex linkage apparatus for locating the blocks during construction; however, the complex arrangement of the linkage connected to a pivot anchor is awkward to use in practice.

In Crock, a mold is provided for forming a single construction block which is intended to be similar to the shape of a conventionally formed block for forming an igloo. The mold surrounds both top and bottom sides of the finished block with the outer side of the block being the exposed side to permit releasing from the mold. In this construction, the block cannot be deposited from the mold into place in the igloo structure, but rather the block must first be released from the mold and then subsequently placed in position in the igloo structure under construction. The orientation of the tapering walls would not permit the blocks to be released directly from the mold into position in the assembled igloo structure. Furthermore, the smooth walls make it difficult to retain the block in place during construction.

SUMMARY OF THE INVENTION

According to one aspect of the invention there is provided a building block mold comprising a shell defining a pair of generally cuboid mold portions joined with one another at respective inner sides of the mold portions, the shell comprising:

a bottom wall spanning a bottom end of each mold portion;

an opening spanning a top end of each mold portion opposite the respective bottom wall;

an outer side wall spanning between the bottom end and the top end of each mold portion at an outer side of the respective mold portion opposite the respective inner side joined with the other mold portion; and a pair of end walls spanning opposing ends of each mold portion such that each end wall extends between the top and bottom ends of the respective mold portion and extends between the respective inner and outer sides of the respective mold portion;

the inner sides of the respective mold portions being at least partially open such that the mold portions are at least partially open to one another at the inner sides thereof; and the mold portions being offset from one another along a plane of intersection of the mold portions within which each of the inner sides of the respective mold portions span.

The mold portions may be offset from one another in an upright direction extending between the top and bottom ends of the mold portions, in a lateral direction extending between the end walls of each mold portion, or any combination thereof.

By providing a mold comprising two generally cuboid mold portions which are offset from one another, a resulting building block is produced which when stacked on a previous row of blocks permits inter-engagement between the blocks due to a shoulder being formed on each block which engages the corresponding shoulder of a subsequent block supported thereon. By providing an offset both in an upright direction and in the lateral direction two edges of each block are inter-engaged with corresponding blocks as the block is placed in the desired position in the igloo structure during construction. By arranging the walls of the mold to taper from one outer side wall to the opposing outer side wall with an open top end thereabove, a suitable block is formed which can be deposited from the mold directly onto the igloo structure without additional handling of the block being required.

Preferably there is provided an inner side wall spanning in the upright direction between the bottom walls of the mold portions.

The mold portions may be offset from one another in a lateral direction extending between the end walls of each mold portion.

There may also be provided an inner side wall spanning in the lateral direction between each end wall and a corresponding one of the end walls of the other mold portion.

The inner sides of the mold portions are preferably fully open with one another at an area of overlap between the mold portions.

Opposing ones of the walls of the mold portions may taper inwardly towards one another from the top end to the bottom end of the mold portions.

The end walls preferably taper towards one another in a direction extending from one outer side wall to the opposing outer side wall.

One of the outer side walls may be longer between respective ones of the end walls than the other outer side wall, in which the longer one of the outer side walls extends away from the respective bottom wall beyond the top end of the other mold portion.

When one of the outer side walls is longer than the other one of the outer side walls in a direction extending between the end walls, the longer one of the outer walls preferably has a concave inner surface and the other one of the outer side walls preferably has a convex inner surface.

The outer side walls may each have a respective radius of curvature about a common center point.

The end walls are preferably perpendicular to the respective outer side walls at a point of intersection therewith.

When the mold portions are offset from one another in a lateral direction extending between the end walls of each mold portion, preferably there is provided an inner side wall spanning in the lateral direction between each end wall and a corresponding one of the end walls of the other mold portion and the inner side wall preferably follows a curvature of the outer side wall.

The pair of end walls and the outer side wall of each mold portion preferably terminate in a plane of the opening at the respective top end of the respective mold portion.

There may be provided a handle extending outwardly from each outer side wall.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
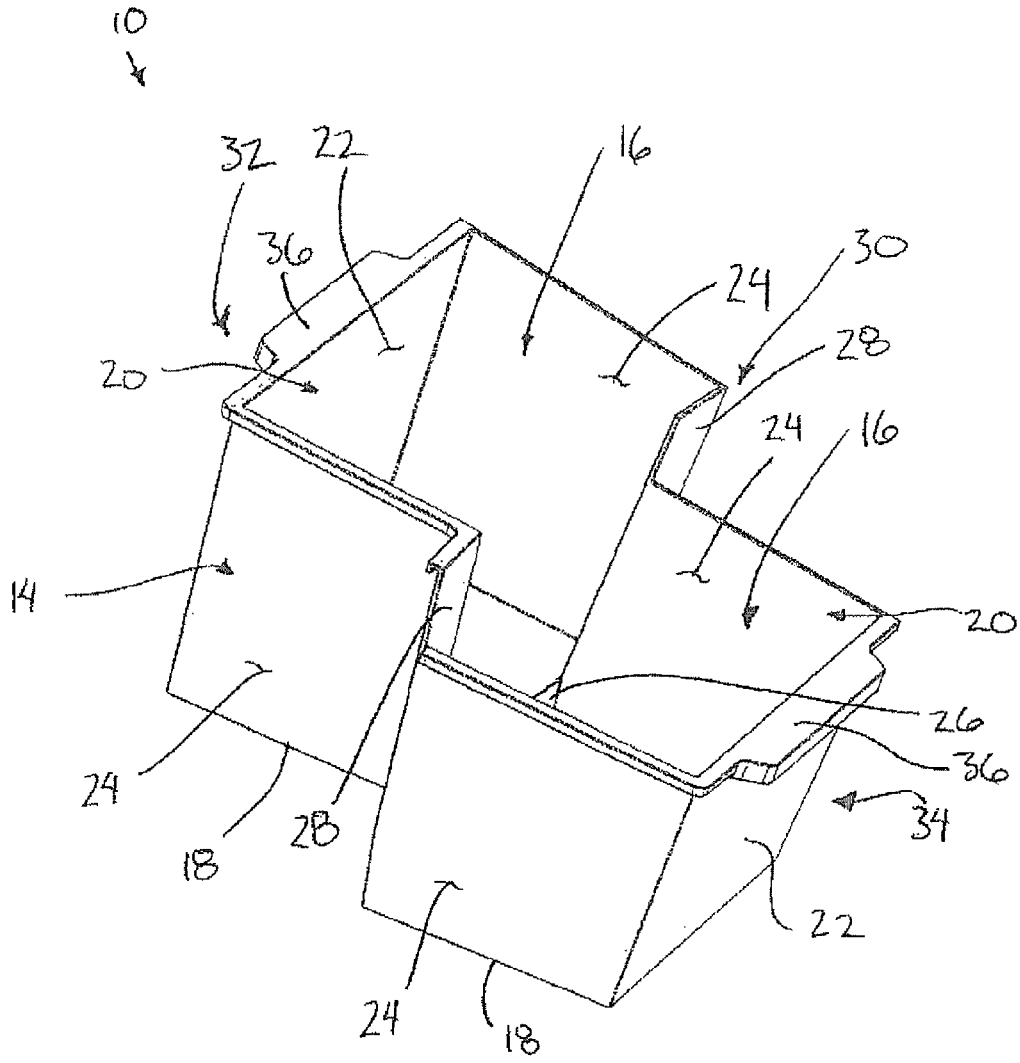
FIG. 1 is a perspective view of the mold.

Referring to the accompanying figures there is illustrated a building block mold generally indicated by reference numeral 10. The mold 10 is particularly suited for building a structure having walls which curve in one or two different directions, for example a dome structure such as an igloo 12, which is formed of a moldable particulate material, for example snow.

The mold 10 comprises a rigid shell 14 which is formed of a substantially rigid plastic material in the illustrated embodiment. The shell 14 is formed to define two generally cuboid or hexahedron mold portions 16 which are adjacent and joined with one another at a plane of intersection while being offset from one another in two perpendicular directions along the plane of intersection. Each mold portion is said to be generally cuboid as some of the faces of the shell 14 surrounding each mold portion 16 are in fact slightly curved and have perimeters which are generally trapezoidal and not square, despite the overall form of each mold portion being generally rectangular or cubic.

Each mold portion includes a bottom wall 18 spanning a bottom end of the mold portion. Each mold portion also includes an opening 20 which spans an opposing top end so that the plane of each opening 20 is near parallel to the respective bottom wall and is spaced from the respective bottom wall by a height which is near the height of the other mold portion.

Each mold portion also includes an outer side wall 22 which spans an outer side of the mold portion between the top and bottom ends thereof at an outer side of the mold portion which is farthest from the inner side 30 joined to the other mold portion at the plane of intersection of the mold portions.

End walls 24 are provided in pairs at opposing ends of each mold portion. The end walls 24 extend and span between the top and bottom ends of the respective mold portion 16 as well as extending and spanning between the respective inner and outer sides thereof.

The two mold portions 16 are offset from one another along the plane of intersection at the inner sides where the mold portions are joined with one another in both an upright direction and a lateral direction perpendicular to the upright direction. The upright direction spans along the plane of intersection generally parallel to the outer side walls between the top and bottom ends of the mold portions. The lateral direction spans in the direction of the outer side walls between the end walls.

The shell 14 also includes a first inner side wall 26 spanning between the two bottom walls along the plane of intersection to span between the vertical offset of the two mold portions along the length thereof between opposing ends of each mold portion. Two second inner side walls 28 are also provided which lie in the same plane as the first inner side wall 26 but which span between corresponding end walls between the two different mold portions 16 at opposing ends thereof. The second inner side walls 28 thus connect the two mold portions together between the offset in the lateral direction thereof. The inner sides 30 of the two mold portions remain fully open between the two mold portions so that the mold portions remain fully open to one another at the point of intersection and at an overlap therebetween in the intersection plane.

Figure 11:
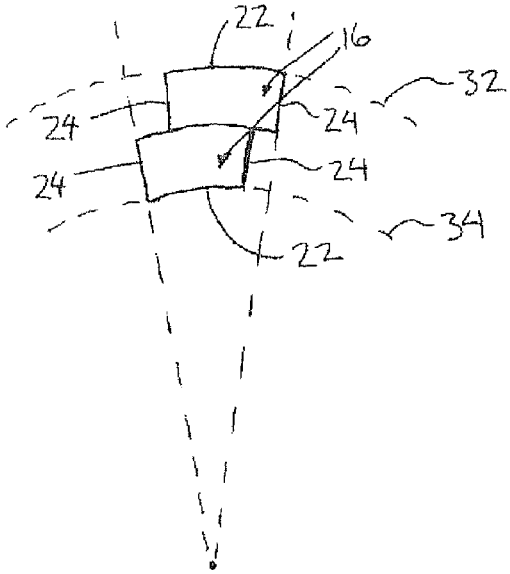
FIG. 11 is a schematic top plan view of the mold.

FIG. 11 illustrates a schematic representation of the resulting block formed by the mold in plan view in which the shape is exaggerated for illustrative purposes. As illustrated a first one 32 of the outer side walls 22 is arranged to be longer than a second one 34 of the outer side walls 22 so that the second one is shorter to follow the inside of a domed structure while the longer one 32 follows the convex outer wall of the domed structure being assembled. The outer surface of the first one 32 of the side walls 22 is accordingly convex while the interior thereof is concave. Similarly the shorter second one 34 of the outer side walls 22 is concave at the outer surface thereof and convex at the inner surface thereof when viewed in plan view. Both outer side walls 22 have a respective radius of curvature which differs from one another but which are centered at a common center point so that when a plurality of blocks are positioned side by side, the side walls of the resulting structure being formed at the inner and outer sides thereof remain parallel due to the parallel configuration of the outer side walls 22 relative to one another along the curve thereof.

The end walls 24 are all arranged to taper inwardly from the first one 32 of the outer side walls 22 to the second one 34 of the outer side walls 22 so that each end wall meets the respective outer side wall perpendicularly thereto. The end walls are thus arranged to be spaced farther apart from one another at the first one 32 of the outer side walls 22 and gradually get closer together through both mold portions towards the second one 34 of the outer side walls 22.

The end walls 24 also taper inwardly towards one another in the upright direction so as to be farthest from one another at the open top end of each mold portion and to approach one another to be nearest one another adjacent the bottom wall at the bottom end of each mold portion.

Figure 2:
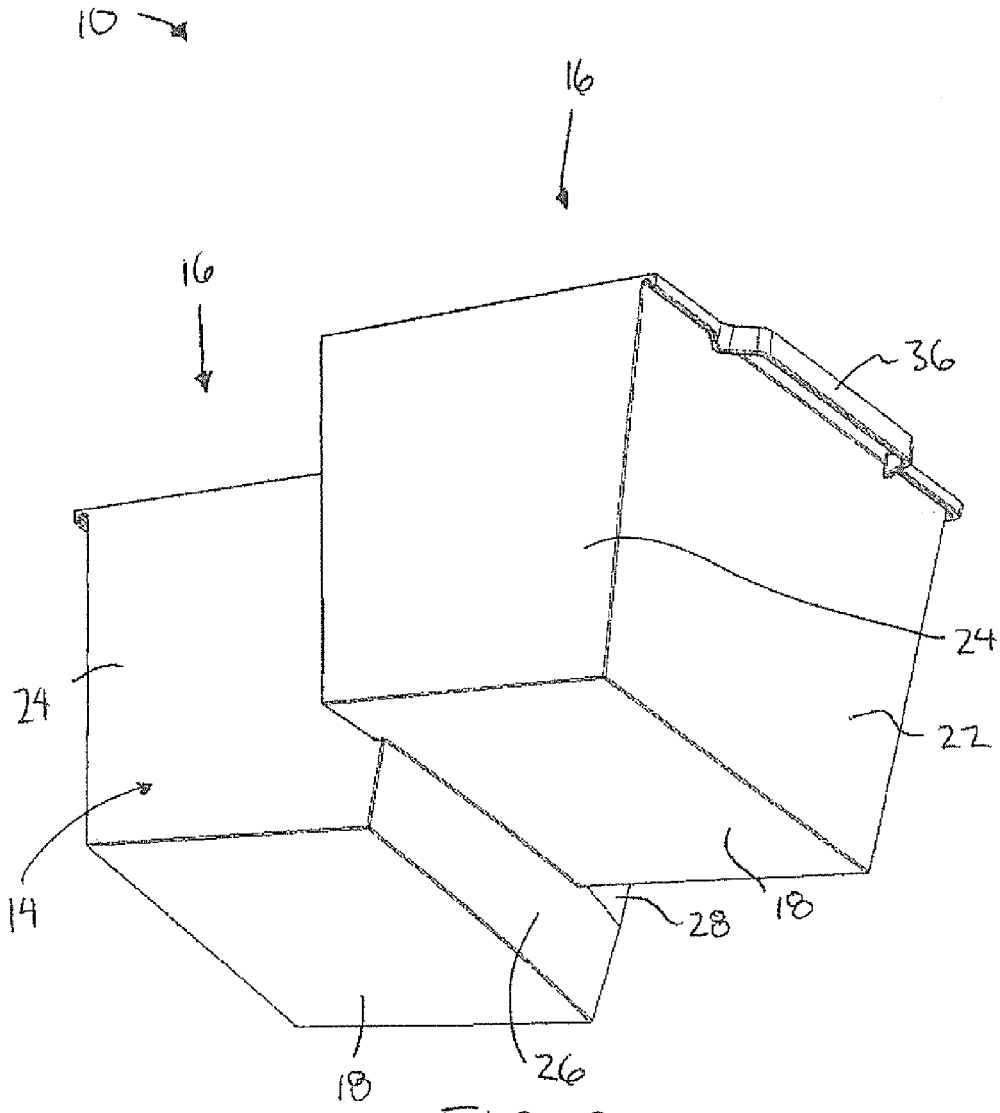
FIG. 2 is a perspective view of the mold illustrating the bottom wall of each mold portion.
Figure 3:
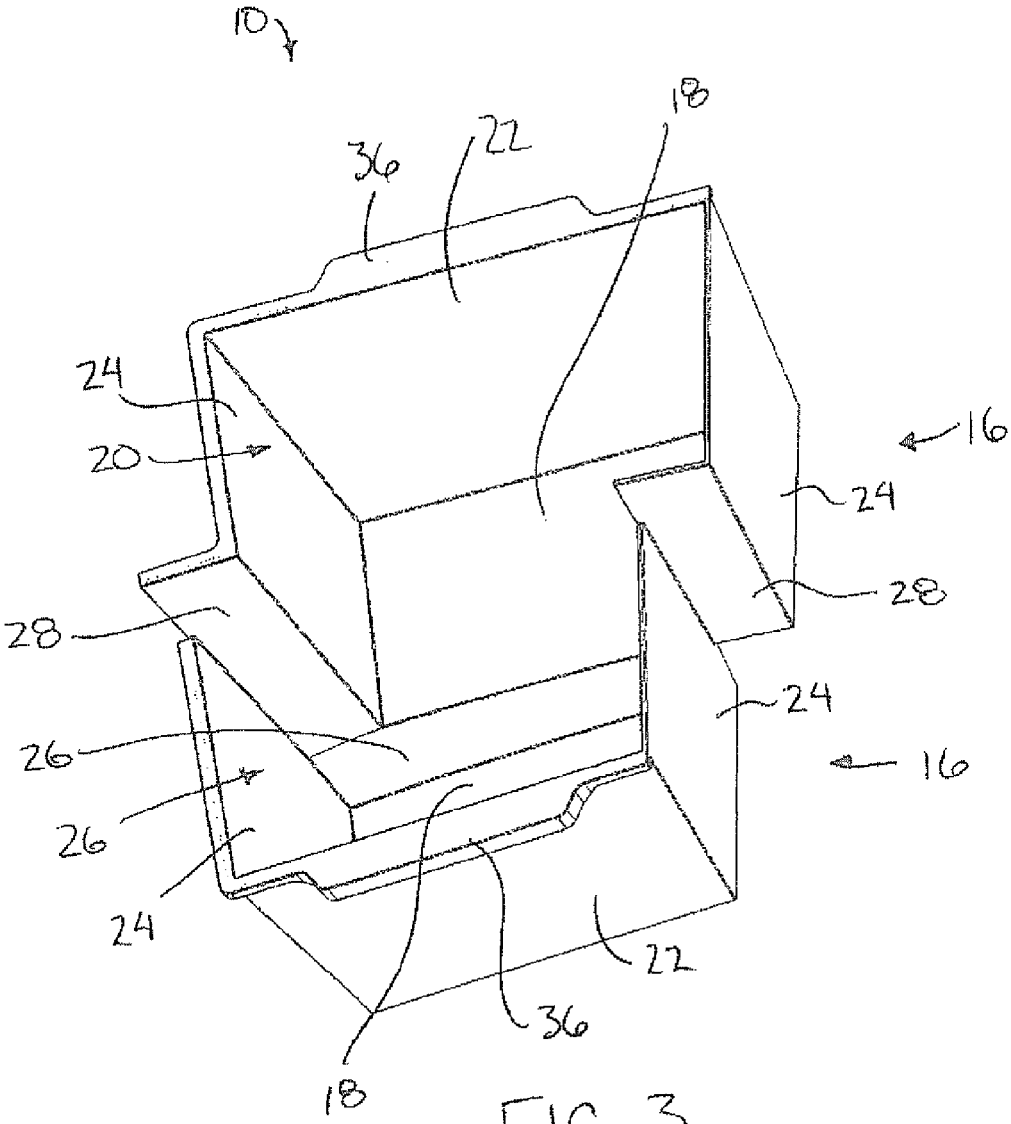
FIG. 3 is a perspective view illustrating the interior of the mold through the open top end.
Figure 4:
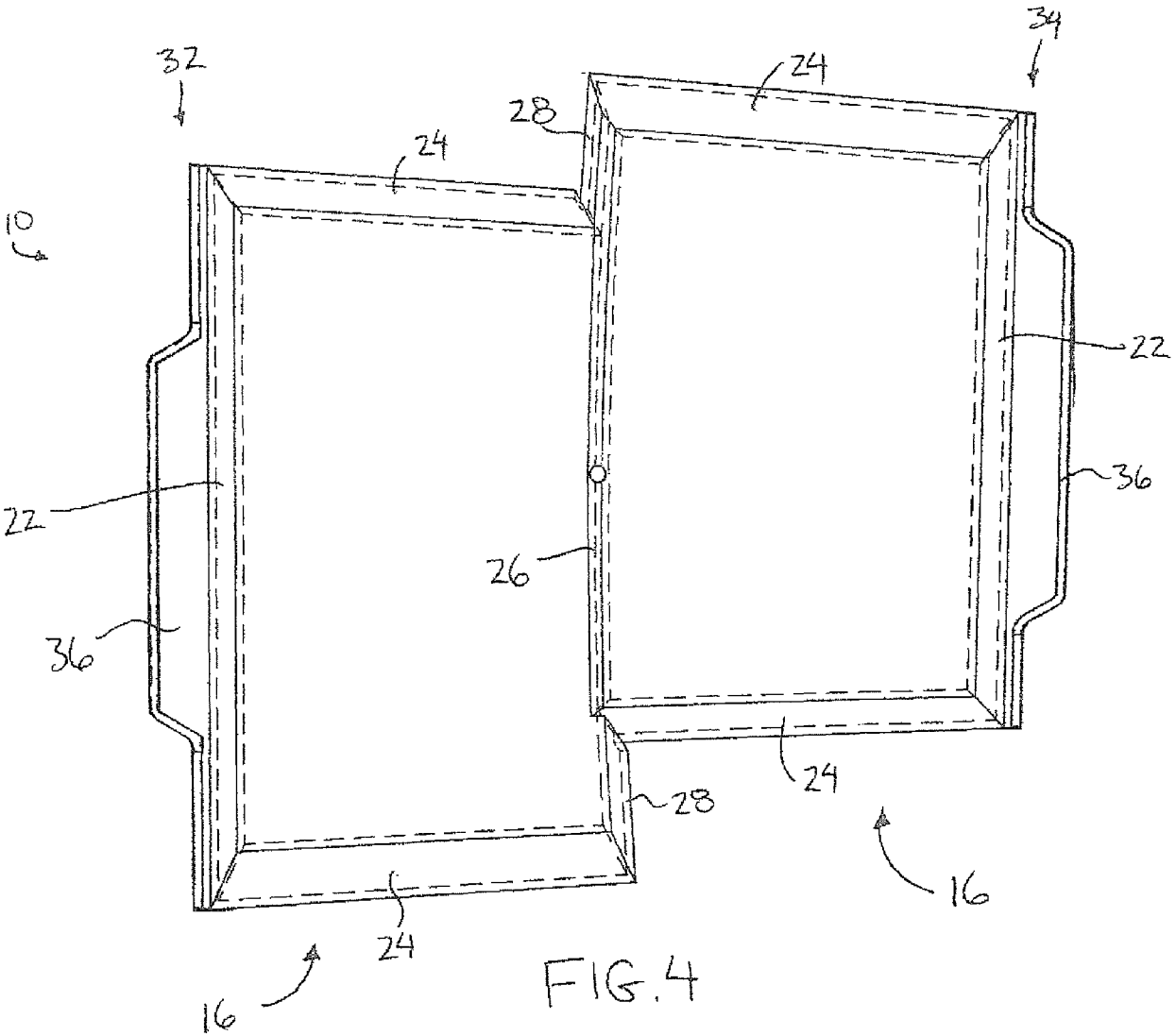
FIG. 4 is a bottom plan view of the mold.
Figure 5:
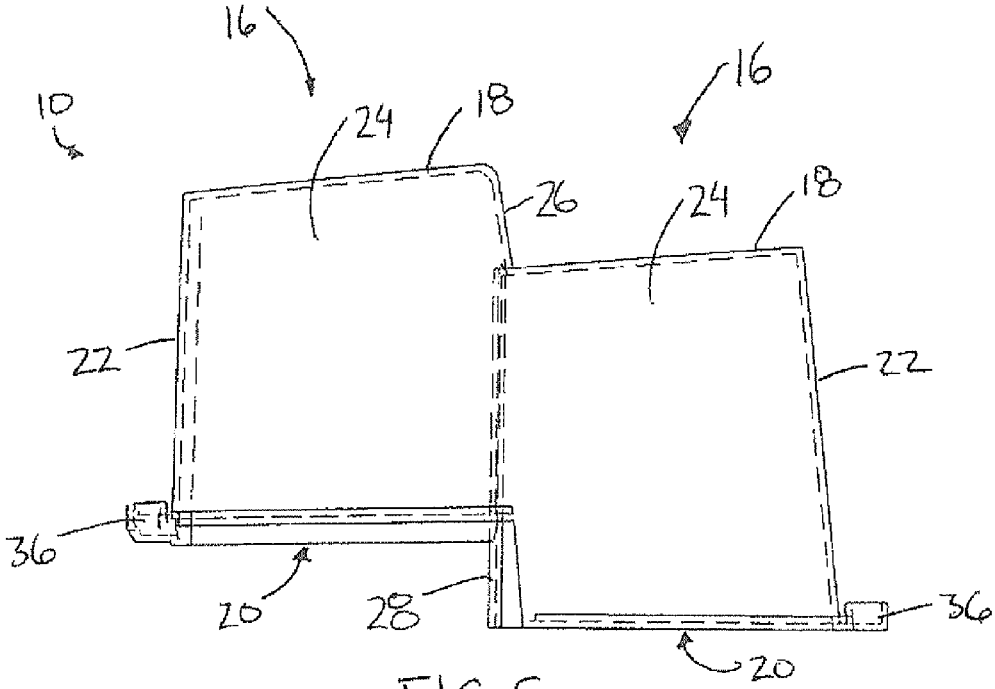
FIG. 5 is an end elevational view of the mold.
Figure 6:
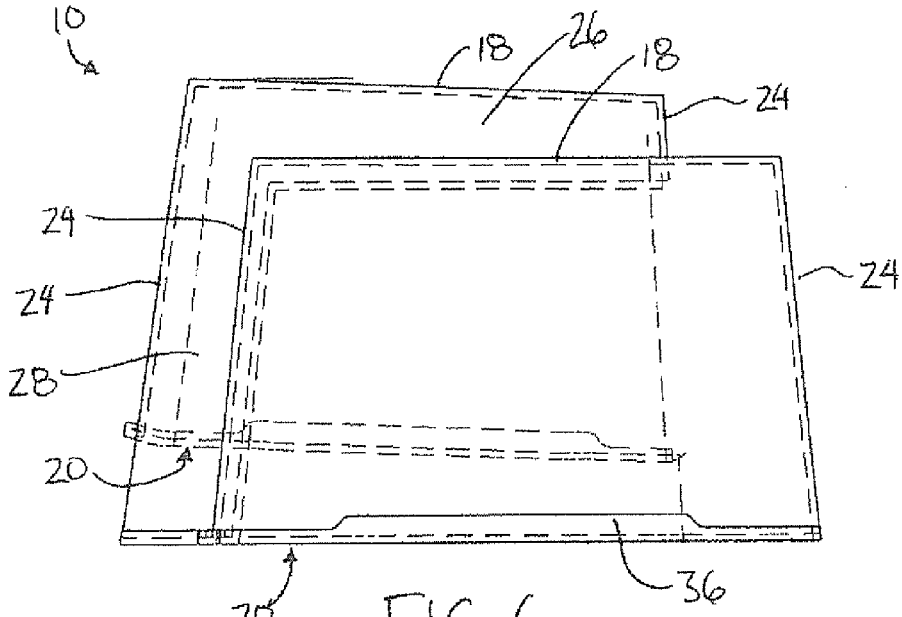
FIG. 6 is an elevational view of a longest one of the outer side walls.
Figure 7:
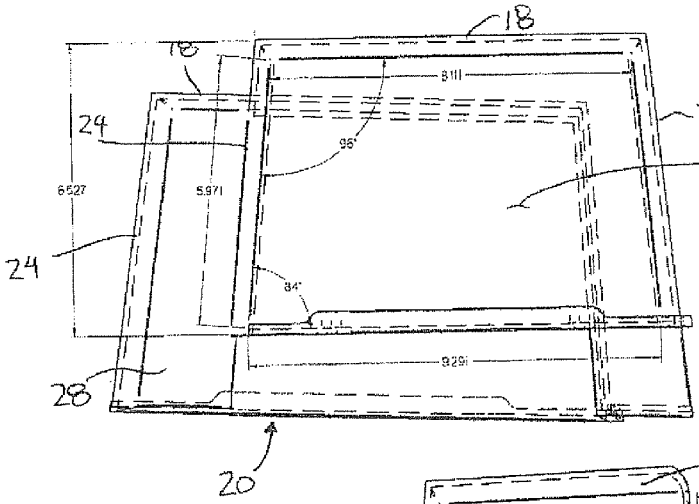
FIG. 7 is an elevational view of a shortest one of the outer side walls.
Figure 8:
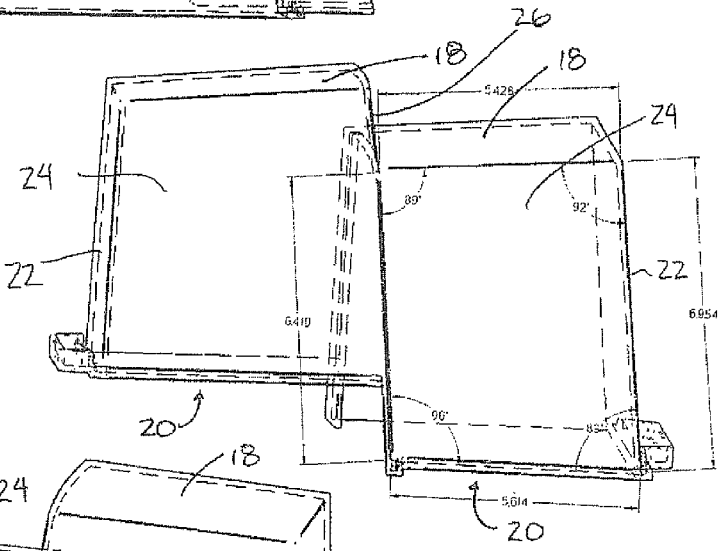
FIG. 8 is a perspective view of the end wall of FIG. 5.
Figure 9:
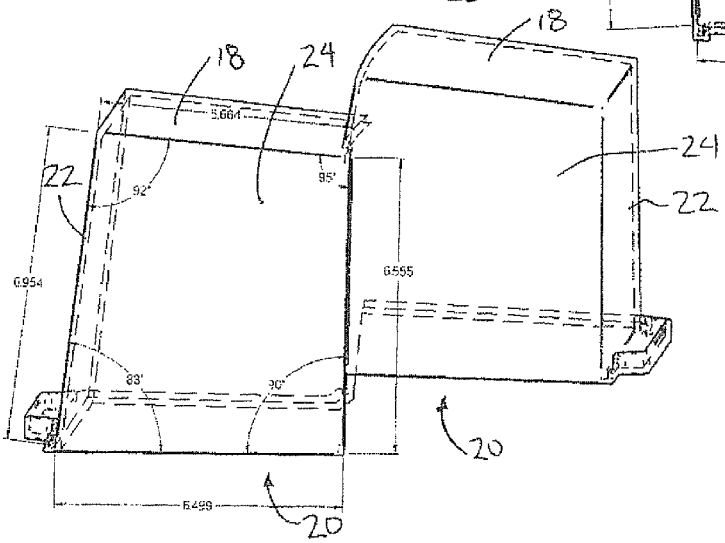
FIG. 9 is a perspective view of the opposing end wall in relation to FIG. 8.
Figure 10:
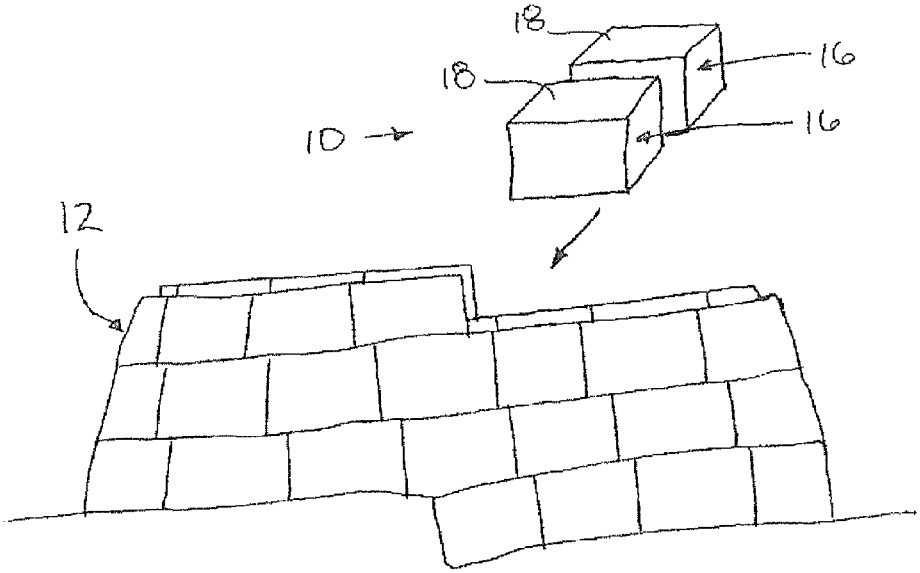
FIG. 10 is a schematic illustration of a block formed by the mold as it is mounted on an igloo structure.

The end walls 24 and the outer side wall 22 associated with each mold portion are arranged to terminate at an upper edge which is in the plane of the opening at the top end of the respective mold portion so that the end walls and the outer side wall 22 of one of the mold portions extends away from the respective bottom wall beyond the top end of the other mold portion. More particularly the end walls 24 associated with the longest one 32 of the outer side walls 22 are arranged to extend upwardly beyond the opening of the other mold portion. Both second inner side walls 28 extend from the bottom of the respective mold portion to terminate at a top edge which is in the common plane of the opening of the uppermost one of the mold portions associated with the longest one 32 of the outer side walls 22. The plane of opening of the two mold portions are arranged to be offset from one another in the upright direction by the same amount of offset of the bottom walls thereof. As shown in FIGS. 1 through 3 one end wall 24 of one mold portion and a corresponding end wall 24 of the other mold portion along a common side of the shell, together with the inner side wall 28 spanning between the corresponding end walls 24 each terminate at a respective upper free edge lying in a plane of the respective wall.

Each of the outer side walls 22 mounts a handle 36 thereon which projects outwardly from the respective outer side wall centrally located thereon and generally within the plane of the opening of the respective mold portion.

In use, the rigid shell 14 of the mold is filled with snow up to the plane of the opening at the top end of both mold portions 16. Within a matter of seconds, the snow sets into a rigid block which can be removed from the mold and used in construction of an igloo or other desired structure. When forming an igloo, the mold is inverted so that the blocks can be deposited directly into place in the igloo structure prior to the mold being released from the block. The inverted mold is then simply lifted from the block which is already in position in the igloo structure. Locating the handles on the outer side walls 22 ensures that the handles do not interfere with positioning of the blocks directly adjacent other blocks in the igloo structure being assembled. The first row of blocks are positioned in a generally spiral pattern so that the first and last blocks in the first row of blocks have a difference in elevational of one block when a complete circumference as formed by the first row.

Blocks are then continuously placed end to end in a continuing spiral pattern to form subsequent rows of block. Each row of blocks is positioned so that the shorter one of the outer side walls 22 is positioned at the interior of the igloo structure being assembled. Due to the longer one of the outer side walls 22 being positioned at the exterior and due to its configuration to extend upwardly beyond the opening of the mold portion associated with the shorter one of the outer side walls 22 the resulting inverted block defines an outer one of the mold portions which is stepped down in relation to the inner one of the mold portions while the top and bottom sides thereof slope downwardly and inwardly into the interior of the igloo structure.

Figure 12:
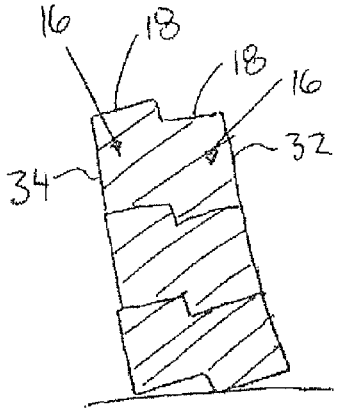
FIG. 12 is an end elevational view of a plurality of rows of blocks stacked one above the other which are formed by the mold.

Stacking subsequent rows of blocks thus results in an upwardly and inwardly inclining wall structure with each block being retained by inter-engaging shoulders as best illustrated in FIG. 12. The difference in height of the bottom walls of the two mold portions results in the first inner side wall 26 forming a first shoulder facing outwardly which is engaged by the shoulder of a subsequently formed block which is in turn formed by the difference in elevation of the plane of openings of the two mold portions of the mold.

In addition to the inter-engagement of the shoulders at the top and bottom walls of the blocks, the lateral offset provided by the two second inner side walls 28 defines inter-engaging shoulders in the subsequently formed bricks which engage one another so that the free end of each subsequent block being deposited has a shoulder which faces outwardly in relation to the curved wall of the dome structure being assembled. Accordingly a subsequently installed block positioned adjacent thereto is further prevented from sliding inwardly by inter-engagement of shoulders with the previous one of the installed blocks.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A building block mold comprising a shell defining a pair of generally cuboid mold portions joined with one another at respective inner sides of the mold portions, the shell comprising:

a bottom wall spanning a bottom end of each mold portion;

an opening spanning a top end of each mold portion opposite the respective bottom wall;

an outer side wall spanning between the bottom end and the top end of each mold portion at an outer side of the respective mold portion opposite the respective inner side joined with the other hold portion;

a pair of end walls spanning opposing ends of each mold portion such that each end wall extends between the top and bottom ends of the respective mold portion and extends between the respective inner and outer sides of the respective mold portion;

the inner sides of the respective mold portions being at least partially open such that the mold portions are at least partially open to one another at the inner sides thereof; and the mold portions being offset from one another along a plane of intersection of the mold portions within which each of the inner sides of the respective mold portions span such that:

the mold portions are offset from one another in an upright direction extending between the top and bottom ends of the mold portions; and the mold portions are offset from one another in a lateral direction extending between the end walls of each mold portion;

an inner side wall spanning in the upright direction between the bottom walls of the mold portions; and an inner side wall spanning in the lateral direction between each end wall and a corresponding one of the end walls of the other mold portion;

wherein opposing ones of the end walls of the mold portions taper inwardly towards one another from the top end to the bottom end of the mold portions such that the outer side wall of each mold portion is generally trapezoidal in shape.

2. The mold according to claim 1 wherein the inner sides of the mold portions are fully open with one another at an area of overlap between the mold portions.

3. The mold according to claim 1 wherein the end walls taper towards one another in a direction extending from one outer side wall to the opposing outer side wall.

4. The mold according to claim 1 wherein one of the outer side walls is longer between respective ones of the end walls than the other outer side wall, said one of the outer side walls extending away from the respective bottom wall beyond the top end of the other mold portion.

5. The device accordingly to claim 1 wherein one of the outer side walls is longer than the other one of the outer side walls in a direction extending between the end walls, said one of the outer walls having a concave inner surface and the other one of the outer side walls having a convex inner surface.

6. The device according to claim 5 wherein the outer side walls each have a respective radius of curvature about a common center point.

7. The mold according to claim 5 wherein the end walls are perpendicular to the respective outer side walls at a point of intersection therewith.

8. The mold according to claim 5 wherein the mold portions are offset from one another in a lateral direction extending between the end walls of each mold portion and wherein there is provided an inner side wall spanning in the lateral direction between each end wall and a corresponding one of the end walls of the other mold portion, the inner side walls following a curvature of the outer side wall.

9. The mold according to claim 1 wherein the pair of end walls and the outer side wall of each mold portion terminate in a plane of the opening at the respective top end of the respective mold portion.

10. The mold according to claim 1 wherein there is provided a handle extending outwardly from each outer side wall.

* * * * *